US008100670B2

(12) United States Patent
Bodart et al.

(10) Patent No.: US 8,100,670 B2
(45) Date of Patent: Jan. 24, 2012

(54) LIQUID PROPULSION DEVICE INCORPORATING A PYROTECHNIC GAS GENERATOR IN THE STRUCTURE THEREOF

(75) Inventors: Vincent Bodart, Paris (FR); Anthony Schyns, Saint Medard en Jalles (FR)

(73) Assignee: Pyroalliance, Les Mureaux (FR)

( * ) Notice: Subject to any disclaimer, the term of this patent is extended or adjusted under 35 U.S.C. 154(b) by 469 days.

(21) Appl. No.: 12/439,020

(22) PCT Filed: Aug. 31, 2007

(86) PCT No.: PCT/FR2007/051858

§ 371 (c)(1),
(2), (4) Date: Feb. 26, 2009

(87) PCT Pub. No.: WO2008/025930

PCT Pub. Date: Mar. 6, 2008

(65) Prior Publication Data

US 2009/0202364 A1 Aug. 13, 2009

(30) Foreign Application Priority Data

Sep. 1, 2006 (FR) ..... 0653552

(51) Int. Cl.
*F04F 5/00* (2006.01)
*F04B 23/04* (2006.01)

(52) U.S. Cl. ..... 417/158; 137/831; 137/76

(58) Field of Classification Search ..... None
See application file for complete search history.

(56) References Cited

U.S. PATENT DOCUMENTS

| | | | | |
|---|---|---|---|---|
| 3,134,534 | A * | 5/1964 | Jancke et al. | 417/153 |
| 5,059,637 | A | 10/1991 | Langer | |
| 2002/0146324 | A1 * | 10/2002 | Popov et al. | 417/54 |

FOREIGN PATENT DOCUMENTS

| | | | |
|---|---|---|---|
| EP | 1 136 330 | A1 | 9/2001 |
| FR | 2 855 769 | A1 | 12/2004 |
| WO | WO 2006/061539 | A2 | 6/2006 |

* cited by examiner

*Primary Examiner* — Joseph L Williams
(74) *Attorney, Agent, or Firm* — Hamre, Schumann, Mueller & Larson, P.C.

(57) ABSTRACT

The subject of the present invention is a device (50) for propelling a liquid (L) comprising a reservoir (51) equipped with a mobile separation member (57) and a pyrotechnic gas generator (1), which is arranged inside said reservoir (51), equipped with nozzles (4*a*, 4*b*, 4*a'*, 4*b'*). Characteristically, said nozzles (4*a*, 4*b*, 4*a'*, 4*b'*) of said gas generator (1) are arranged radially on the wall(s) of said body (2) and said gas generator (1), arranged in such a way that its axis corresponds to the line of travel of said mobile separation member (57), is equipped with a deflector (8) to deflect said generated combustion gases (G) along said line of travel of said mobile separation member (57).

10 Claims, 2 Drawing Sheets

LIQUID PROPULSION DEVICE INCORPORATING A PYROTECHNIC GAS GENERATOR IN THE STRUCTURE THEREOF

The present invention relates to devices for propelling liquids, comprising within their structure a pyrotechnic gas generator.

Fire extinguishing devices (which are examples of liquid-propelling devices) generally comprise a reservoir containing an extinguishant. Said extinguishant is intended to be spread over the area of the fire with a view to extinguishing said fire and also preventing it from spreading.

Conventional reservoir-type extinguishers are of the stored pressure type. The disadvantage with these extinguishers is that an extinguishant or a gaseous propellant of such an extinguishant is stored under permanent pressure, with the need for monitoring and checking (for example periodic weighing) operations that that entails. Storing the extinguishant under pressure is particularly delicate (because of the problem of micro leaks).

As an alternative to the stored pressure systems, systems have been proposed that use a pyrotechnic gas generator, particularly for fire fighting in aircraft engines. Numerous documents, notably EP-A-0 956 883, EP-A-1 609 507, EP-A-1 552 859, US-A-2005/150665 and BE-A-1 010 421, describe such systems. The greater efficiency and compactness of pyrotechnic gas generators means that liquid extinguishants can be propelled while at the same time maintaining a high level of performance. The chief disadvantage with these systems is that they place the combustion gases of the pyrotechnic gas generator in direct contact with the liquid extinguishant. There may therefore be some mixing between said gases and said liquid extinguishant (that is to say that an emulsion may be formed), making it difficult to control the discharge conditions and entailing a cooling of said gases, which cooling becomes all the more important as said extinguishant involved is a liquid with a high calorific value and is still detrimental to the desired pressurizing effect.

Patent Application WO-A-2006/061539 describes a fire extinguishing device comprising a reservoir of (liquid) extinguishant and means for generating a pressurized gas, it being possible for said means to consist of a pyrotechnic gas generator. A separation element, for example a flexible membrane, is provided to separate said gas generator from said extinguishant. As said generator operates, the membrane deploys under the effect of the pressure of the gases and drives said extinguishant from the reservoir via a calibrated blow-out disk that ruptures under the effect of the pressure of said extinguishant. Said membrane greatly limits, or even completely prevents, any mixing between the combustion gases and said extinguishant. The pyrotechnic gas generator is equipped with at least one outlet orifice for directing the gases. In the variant specifically described, it is equipped with two outlet orifices, formed axially, facing the membrane. A configuration such as this places a great deal of stress on said membrane, both from a thermal and from a mechanical viewpoint, and carries the risk of leading to membrane damage or puncturing. Especially in the first few moments of operation of the generator, the gas generator actually delivers highly localized darts of hot gases onto said membrane.

A tight set of specifications for such systems with pyrotechnic gas generators includes in particular the following requirements:

- a duration of application of the liquid extinguishant lasting several seconds. This entails generators with longer periods of operation than those conventionally used for automotive safety applications (which are a few tens of milliseconds in the case of driver airbags). The pyrotechnic charges involved will thus advantageously be larger in size and have lower burn rates than those used in automotive safety;
- regulation of operation: providing a uniform operating pressure within a given range of conditioning temperatures. One of the specific features of pyrotechnic generators applied to on-board systems, particularly aeronautical ones, is that they should operate in extreme temperature ranges (said systems are subjected to the local temperature conditions on the ground at the airport (which may be in a desert or polar region) and to the temperature conditions at altitude, during flight). Now, those skilled in the art are aware of how the burn rate of pyrotechnic material is dependent on ambient temperature (this potentially leading to variation in the operation of the gas generator which might then no longer be able to meet the functional requirements of the system at all service temperatures) and of how said burn rate depends on the pressure in the combustion chamber, which pressure is dictated by a nozzle. When faced with this technical problem there are numerous systems for regulating the operation that have already been proposed. These are aimed at ensuring that the generator has a uniform operating pressure within a given range of conditioning temperatures;
- limitation of the mixing between the gases emitted by the pyrotechnic gas generator and the liquid extinguishant;
- limitation of the thermal and mechanical stresses placed upon the mobile separation member (for example the flexible membrane) when such a member is present.

In a context such as this, the inventors propose a particularly advantageous device for propelling a liquid using a pyrotechnic gas generator.

In the conventional way, said device comprises:

- a reservoir in which to store the liquid (and its gas blanket. For safety reasons (with respect to possible expansion of the liquid), said liquid is in fact always stored with a gas blanket) at its saturation vapor pressure, equipped with a means for delivering said liquid once pressurized;
- a pyrotechnic gas generator arranged inside said reservoir to pressurize said liquid inside said reservoir and propel it once pressurized out of said reservoir, via said open delivery means; said gas generator having a body of cylindrical geometry (said body is advantageously a cylinder of revolution but this is merely one entirely non-limiting advantageous variant), capable of accommodating and holding in a stable manner a pyrotechnic charge that can burn within it, generating combustion gases, with nozzles, at least some of which are initially completely obturated by obturating means capable of rupturing (that is to say frangible obturating means) under the pressure of said generated combustion gases, so as to deliver said combustion gases under pressure;
- a mobile separation member arranged inside said reservoir to separate said liquid from said generator and from said generated combustion gases.

The gas generator is thus arranged inside the liquid reservoir (it is advantageously secured to the wall of said reservoir) and is separated from said liquid by a mobile separation member. Said mobile member is able to transmit the pressure of the generated gases to said liquid in order to cause said liquid to be expelled from said reservoir.

Characteristically, within the structure of the device of the invention:

the nozzles of the gas generator are arranged radially on the wall(s) of the body of said generator; and said gas generator, arranged in such a way that its axis corresponds to the line of travel of said mobile separation member, is equipped with a deflector to deflect said generated combustion gases along said line of travel of said mobile separation member.

Characteristically, within the structure of the device of the invention, the pyrotechnic generator, positioned "at the top of the reservoir" (facing the surface of the liquid), combines within its structure radial nozzles and deflector so that the generated gases are emitted perpendicular to the axis of the generator (via said radial nozzles) and, having impinged on the deflector, are ultimately delivered along the axis of said generator.

Said generator is thus positioned in a stable manner (the propulsive effect of the gases is minimized) and the action, which is an indirect action, of the generated gases on the mobile separation member is optimized: there is little, if any, mixing between said gases and the liquid; the mechanical and thermal stresses placed upon said mobile separation member are minimized (the gases act on said mobile separation member after they have been slowed and cooled by the deflector); the residues of combustion (which residues of combustion are liable to cause local damage to said mobile separation member and create hotspots) are deposited on the internal wall(s) of the deflector.

A person skilled in the art will have appreciated the full benefit of the device of the invention.

The mobile separation member involved, provided within the reservoir, may notably consist of a flexible deformable membrane.

In the context of an advantageous embodiment variant, the deflector involved is equipped, on that(those) of its faces that face(s) said (radial) nozzles, with an ablatable endothermal coating. An ablatable (errodable, that can be eliminated in layers under the action of the hot and high-speed combustion gases) endothermal layer is known per se. It may in particular contain alumina trihydrate or magnesium hydroxide. Coatings of this type have, for example, been described in U.S. Pat. No. 5,059,637. A coating such as this is advantageously provided in order both to protect the deflector and to increase the cooling of the generated combustion gases (before they impinge on the mobile separation member).

Here are some further details regarding the pyrotechnic gas generator with which the device of the invention is fitted.

It has been mentioned that some of the nozzles of said generator are initially completely obturated by frangible obturation means. Advantageously, all the radial nozzles of the body of the generator of the invention are initially completely obturated by frangible obturating means. Complete obturation such as this isolates, and protects, in fill, the inside of the generator and provides better control over the ignition of the pyrotechnic charge.

Complete obturation such as this is not always absolutely essential, particularly as a result of the presence of the mobile separation member.

The frangible means of obturating the nozzles may consist of any known means suited to this purpose. They may in particular be films or blow-out disks, advantageously calibrated. A single film or at least two superposed films may be used to obturate a nozzle.

The frangible means of obturating the nozzles may be positioned on the inside and/or on the outside of the body of the generator. They are advantageously arranged—films or blow-out discs—on the inside of said body.

Advantageously, at least two of the radial nozzles have different opening-pressure thresholds. The generator involved is then particularly advantageous with reference to the second requirement of the abovementioned set of specifications: regulation of operation. The generator involved is then a particularly well-performing pressure-regulating generator. These have staged radial nozzles. To this end, it is possible in particular to have:

at least two of said radial nozzles that have different opening diameters; and/or at least two of said radial nozzles, initially completely obturated by obturating means; said obturating means having different rupture-pressure thresholds.

Thus, the opening-pressure threshold of a nozzle can be regulated chiefly by altering the diameter of said nozzle and/or the rupture threshold of the obturating means that initially completely obturate said nozzle.

At least two of the nozzles with which the wall(s) of the body of the generator is(are) equipped generally differ in terms of their opening diameter and/or in terms of the rupture pressure threshold of the obturating means that initially completely obturate them.

There are generally 2 to 20 nozzles formed on the body of the generator. Obviously there are at least two nozzles. Advantageously, there are more than two of them so that the effect of the conditioning temperature on the operation of the generator can be moderated in particular as effectively as possible. However, the number of nozzles is reasonably well limited, particularly in view of the size of the generator.

According to an advantageous embodiment variant, the nozzles, which have (almost) identical ((almost) identical=identical or almost identical) opening-pressure thresholds and diameters, are arranged in families at the same height on the wall(s) of the body of the generator in such a way that the sum of the projections, onto a flat frame of reference perpendicular to the axis of symmetry of the generator, of the vectors leading from said axis of symmetry to the orifices of the nozzles is zero. Thus, in the context of a generator body of the type that is a cylinder of revolution, the n nozzles (with identical opening-pressure thresholds and diameters) are advantageously arranged in the same plane, spaced $$\frac{360°}{n}$$

apart.

In the context of this advantageous variant it will have been understood that the nozzles involved are arranged, as indicated, in several planes (at different heights on the wall(s) of the body of the generator).

Arranging the nozzles in this way is particularly advantageous. It makes it possible to minimize, or even avoid, any propulsive effect. It stabilizes the generator of the invention while it is in operation.

When the nozzles, which have (almost) identical opening-pressure thresholds and diameters are present in even numbers, they are therefore ideally arranged in pairs, facing one another, at one and the same height on the wall(s) of the body of said generator (across one and the same diameter of the wall of a body that is in the shape of a cylinder of revolution).

The gas delivered via the radial nozzles originates from the combustion of a pyrotechnic charge held stably in the internal volume of the body of the generator.

Said pyrotechnic charge may consist of a loose collection of pyrotechnic pellets. However, advantageously, it consists of pyrotechnic elements of larger size, with a slower burn rate. It was seen in the introductory part of this description that the invention is aimed more specifically at generators with a long period of operation.

In order to obtain the desired result—namely a slow burn rate—those skilled in the art know that it is mainly the following parameters: the composition, the geometry and the dimensions of the elements that make up the pyrotechnic charge that are available for selection.

Thus, the pyrotechnic charge of the generators fitted to the devices of the invention advantageously consists of a large-sized monolithic (solid or with a central passage) block: a substantially cylindrical monolithic block the two dimensions, thickness and equivalent diameter (or diameter in the case of a perfect cylinder) of which range between 10 and 75 mm.

Said monolithic block advantageously has low porosity, and highly advantageously has a porosity of between 1 and 8% (this parameter, which is expressed as a percentage, corresponds to the ratio between the true density and the theoretical density; and in fact measures the deviation from the theoretical density).

It is advantageously obtained using a method that involves the following successive steps: mixing of powders+granulation+sizing of the granules obtained+shaping of said sized granules using compression.

With reference to the composition of the pyrotechnic charge, it may be added that said composition is advantageously based on a basic copper nitrate and on guanidine nitrate. This composition is chosen with reference to the burn rate parameter but also with reference to other parameters. This type of charge (BCN+GN) as it burns generates no acidic compound liable to cause damage. Its combustion residue is chiefly in the form of aggregates of a particle size very much larger than the dimensions of the nozzles of the generator. It can therefore easily be filtered out.

Following this "digression" relating to the pyrotechnic charge that can be used in the generators fitted to the devices of the invention, let us return to the internal structure of said generators and emphasize, logically, that advantageously, the internal volume of the body of said generators is designed to accept and to hold, in a stable manner, at least one substantially cylindrical monolithic pyrotechnic block the thickness and equivalent diameter of which range between 10 and 75 mm.

More generally, it may be mentioned that said internal volume of the generators is configured with means to accept and to hold in a stable manner the pyrotechnic charge and with means beneficial to the ignition of said pyrotechnic charge.

Said means for accepting and holding in a stable manner the pyrotechnic charge advantageously consist of at least one shelf or basket. A shelf or basket such as this is suited particularly to accepting and to holding in a stable manner a monolithic block like the one described herein above or at least two superposed monolithic blocks of this type, etc.

Said means increase the mechanical ability of the pyrotechnic charge to withstand the vibrational stresses of the generator.

The means beneficial to ignition may comprise a device for accepting and holding an ignition relay pyrotechnic charge (generally positioned at the center of the internal volume of the generators) and an ignition device connected to said ignition relay pyrotechnic charge. Ignition may be initiated remotely via an electro-pyrotechnic igniter.

Advantageously, there is also provided, within the internal volume of the body of the generators, a filter that is positioned in such a way as to surround the pyrotechnic charge.

A filter such as this generally consists of one or more thicknesses of metal grating. A filter such as this is intended to hold back the combustion residue (at least the bulkiest of this) and more especially to hold back, within the body of the generators, the residual solid skeleton of the pyrotechnic charge that is obtained after combustion. The total surface area of the open meshes of such a filter is vastly greater than the combined surface area of the nozzles.

The device of the invention, with the pyrotechnic gas generator with radial nozzles and deflectors, advantageously with a pyrotechnic gas generator of this type with pressure regulation, is particularly well suited to propelling a liquid extinguishant in a fire-extinguishing context; it is especially suited to this purpose in an aeronautical context.

A device of the invention and the operation thereof together with, in greater detail, generators with which such a device can be fitted will now be described entirely nonlimitingly with reference to the attached figures.

FIG. 1 schematically shows a device of the invention, in operation.

Figure 2:
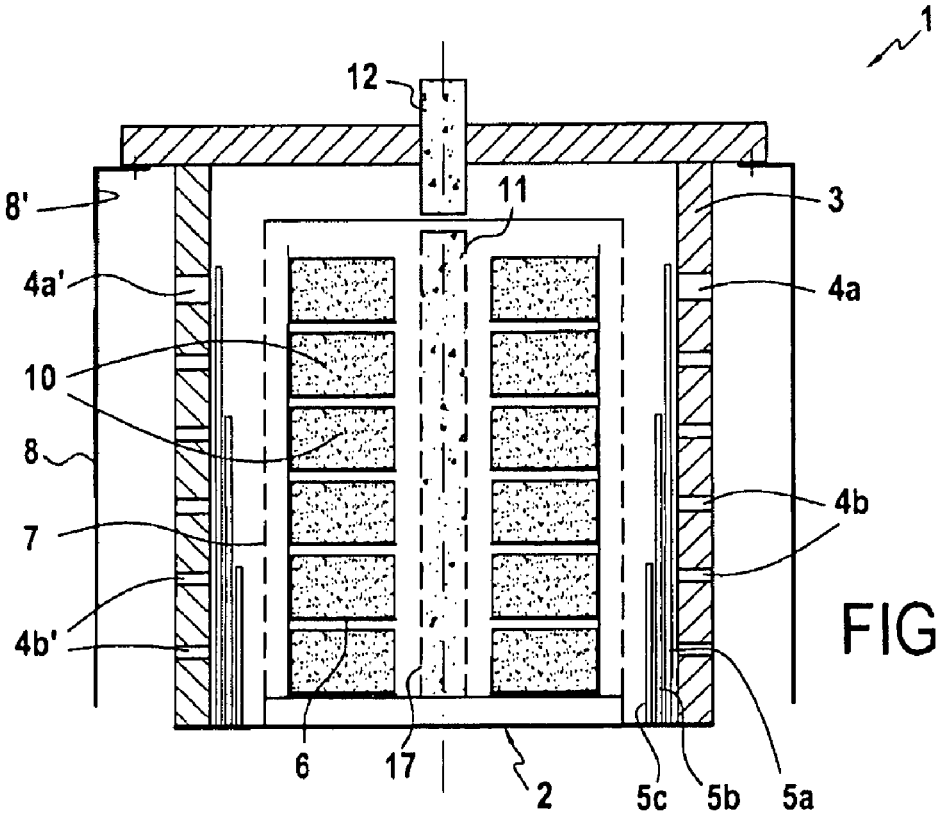
FIG. 2 shows, in section, and highly schematically, a pyrotechnic generator with which the device of FIG. 1 is fitted.

Said device 50 mainly consists of the reservoir 51 fitted with the pyrotechnic gas generator 1 (of FIG. 2). The igniter 12 and the cap of said generator 1 remain outside said reservoir 51.

Figure 1:
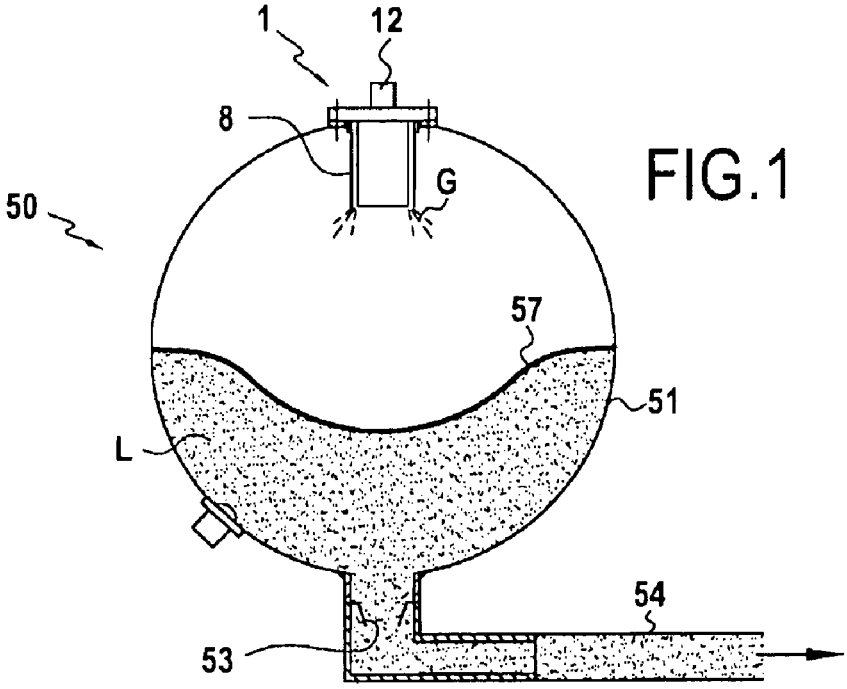
FIG. 1 shows a device 50 for propelling a liquid L, in operation.

Said reservoir 51 of FIG. 1 contains the liquid L. Said liquid L is delivered to the pipe 54 via the open delivery means 53.

Said reservoir 51 of FIG. 1 is fitted with a mobile separation member or membrane 57. Said membrane 57 separates the gaseous propellants G from the liquid L.

The plane in which the gases are delivered (the gases are delivered via radial nozzles: see FIG. 2) is perpendicular to the main axis of the generator 1, in order to avoid any propulsive effect. However, the deflector 8 is able to deflect the flow of gas along the line of travel of the mobile separation member 57. Said deflector 8 thus has the function, as already mentioned, of limiting the thermal and mechanical stresses generated by the very hot and high-speed gases leaving the nozzles in direct contact with the mobile separation member 57 at the start of operation. Another function of said deflector 8 is to halt the combustion residues (that may have passed through the filter 7: see FIG. 2). Said deflector 8 is covered on its face 8', that faces the nozzles, with an ablatable endothermal coating (see FIG. 2).

It may be clearly seen in FIG. 1 that the gas generator 1 is arranged in such a way that its axis corresponds to the line of travel of the mobile separation member 57 and that the deflector 8 can be used to deflect the gases G along said line of travel of said mobile member 57.

The gas generator 1 of FIGS. 1 and 2 has a body 2 of cylindrical geometry. Nozzles 4*a*, 4*a'*, 4*b*, 4*b'* are arranged radially in the wall 3 of said body 2. Not all of said nozzles 4*a*, 4*a'*, 4*b*, 4*b'* have the same opening-pressure threshold (advantageous variant of the invention).

The opening-pressure threshold of the nozzles depicted in FIG. 2 is determined both by the opening diameter of said nozzles and by the rupture threshold of the films initially obturating the openings of said nozzles.

Specifically:

the nozzles 4*a* and 4*a'* of the pair 4*a*/4*a'* have the same opening diameter: da. The nozzles 4*b* et 4*b'* of the pairs 4*b*/4*b'* have the same opening diameter: db. Said opening diameter da of said nozzles 4*a* and 4*a'* is greater than that db of said nozzles 4*b* and 4*b'*: da>db;

films of calibrated thickness 5*a*, 5*b*, 5*c* are used, inside the body 2 of the generator 1, along the walls 3 thereof, to obturate (initially=before said generator 1 operates) all the nozzles 4*a*, 4*a'*, 4*b*, 4*b'*. The nozzles 4*a* and 4*a'* of the 4*a*/4*a'* pair are obturated by the film 5*a*; the nozzles 4*b* and 4*b'* of a 4*b*/4*b'* pair (pair in the uppermost position) are also obturated by said single film 5*a* while the nozzles 4*b* and 4*b'* of two other 4*b*/4*b'* pairs (pair in an intermediate position) are obturated by the film 5*a* and the film 5*b* and the nozzles 4*b* and 4*b'* of two other 4*b*/4*b'* pairs (pairs in a lowermost position) are obturated by all three films 5*a*, 5*b* and 5*c*.

Arranging the nozzles in opposing pairs is designed to minimize, or even destroy, any propulsive effect.

Because of the different opening-pressure thresholds of the nozzle pairs, the generator, in operation, has a low dependency on operating temperature.

Within the structure of the generator 1 there is the deflector 8 for deflecting the gases delivered via the nozzles 4*a*, 4*a'*, 4*b*, 4*b'* (which gases are delivered in a plane perpendicular to the main axis of said generator 1). A deflector 8 such as this is made of a cylindrical sheet. Purely by way of illustration, it may be mentioned here that a sheet such as this is 2 mm thick and is positioned 7 mm away from the walls 3 of the generator 1. It has been seen that the internal face of the deflector 8 is covered with an ablatable endothermal coating 8'.

The generator 1 is schematically depicted with a charge, that is to say with the pyrotechnic charge capable of burning to generate the combustion gases arranged within it.

Said pyrotechnic charge consists of monolithic blocks 10. Said blocks are placed on shelves 6 arranged inside the body 2 of the generator 1.

A filter 7 is positioned around the pyrotechnic charge to hold back the combustion residue.

The burning of the blocks 10 is initiated by a main ignition relay charge 11 situated in a central pipe 17 that is perforated, advantageously at several points, so as to allow the ignition gases to disseminate toward said blocks 10. This ignition charge 11 is itself initiated by an igniter 12 installed on the generator 1.

An igniter 12 such as this is generally electrically connected to the control station via a sealed passage able to withstand the operating pressure of the generator 1.

Figure 3:
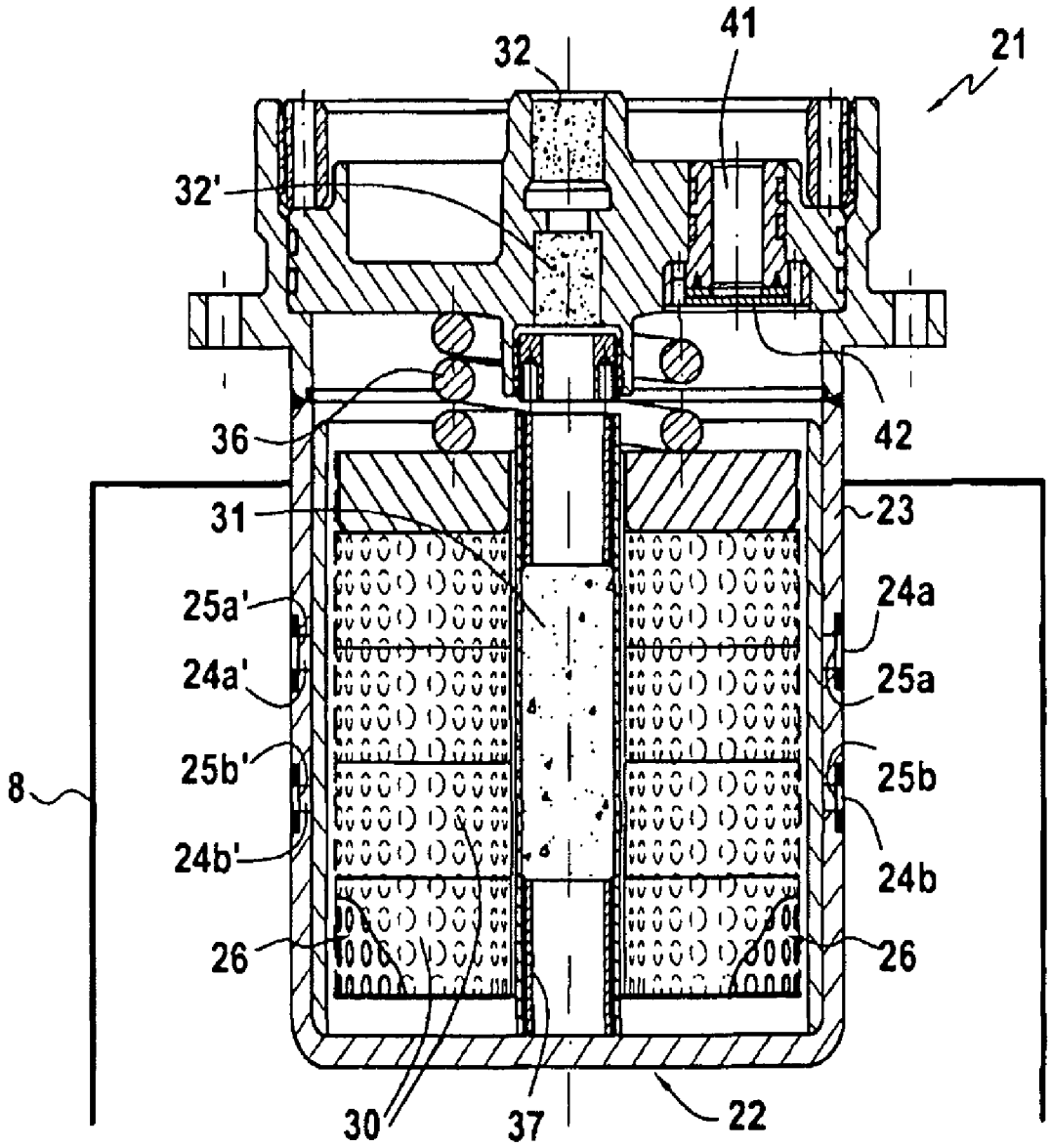
FIG. 3 shows, in section, another pyrotechnic generator with which a device of the invention can be fitted.

The gas generator 21 of FIG. 3 is also depicted complete with charge.

It consists of a mechanical assembly (body 22 of cylindrical geometry delimited by the wall 23) containing:

an initiation module (initiator 32);

an ignition pyrotechnic charge 32';

an ignition relay pyrotechnic charge 31;

a main pyrotechnic charge consisting of monolithic blocks 30.

The ignition relay charge 31 is held at the center of the generator by the device 37.

The main charge (blocks 30) is arranged in a welded stability assembly which is held in place by the spring 36. This welded assembly is made up of pierced sheets which are rolled up and then welded to form receptacles or baskets 26 for the blocks 30 (more specifically stacks of such blocks). Said perforated sheets also act as a filter for the solid combustion residue.

The walls 23 of the body 22 of the generator 21 are pierced with twelve orifices, each one obturated (before the generator 21 operates) by a welded stainless steel blow-out disk 25*a*, 25*a'*, 25*b*, 25*b'* 15 μm thick. Six orifices 24*a*, 24*a'* have a diameter of 35 mm; six orifices 24*b*, 24*b'* have a diameter of 3 mm. Said orifices are arranged in pairs across one and the same diameter. The intention here again is to minimize, or even destroy, any propulsive effect.

Upon operation, the initiator 32 ignites the ignition charge 32' which itself ignites the ignition relay charge 31. Said ignition relay charge 31 then ignites the blocks 30 and allows gases to be generated inside the body 22 and then delivered once the blow-out disks have been blown out of the orifices. The number of orifices opened depends on the conditioning temperature of the gas generator 21.

A blow-out system 41 allows the gas generator 21 to be emptied if the combustion of the pyrotechnic composition (collection of blocks 30) goes into runaway during operation. This system 41 is positioned on the aluminum cap of the body 22 of the generator 21 and consists of a screw-in stainless steel insert to which foils 42 which are 100 μm thick are welded. The pressure at which the generator 21 is emptied can thus be set at 230 bar.

The specifics given hereinabove—figures, types of materials—have been given purely by way of illustration.

The invention claimed is:

1. A device for propelling a liquid comprising:

a reservoir in which to store said liquid at its saturation vapor pressure, equipped with a means for delivering said liquid once pressurized;

a pyrotechnic gas generator arranged inside said reservoir to pressurize said liquid inside said reservoir and propel it once pressurized out of said reservoir, via said open delivery means; said gas generator having a body of cylindrical geometry capable of accommodating and holding in a stable manner a pyrotechnic charge that can burn within it, generating combustion gases, with nozzles, at least some of which are initially completely obturated by obturating means capable of rupturing under the pressure of said generated combustion gases, so as to deliver said combustion gases under pressure;

a mobile separation member arranged inside said reservoir to separate said liquid from said generator and from said generated combustion gases;

wherein said nozzles of said gas generator are arranged radially on the wall(s) of said body, and in that said gas generator, arranged in such a way that its axis corresponds to the line of travel of said mobile separation member, is equipped with a deflector to deflect said generated combustion gases along said line of travel of said mobile separation member.

2. The device as claimed in claim 1, wherein said deflector is equipped on that(those) of its faces that face(s) said nozzles with an ablatable endothermal coating.

3. The device as claimed in claim 1, wherein all said nozzles of said body of said generator are initially completely obturated by obturating means capable of rupturing under the pressure of the generated combustion gases.

4. The device as claimed in claim 1, wherein said means of obturating said nozzles consist of films or of blow-out disks.

5. The device as claimed in claim 1, wherein at least two of said nozzles have a different opening-pressure threshold.

6. The device as claimed in claim 1, wherein at least two of said nozzles have a different opening diameter and/or have different rupture-pressure thresholds of obturating means that initially completely obturated them.

7. The device as claimed in claims 1, characterized in that 2 to 20 nozzles are arranged on the wall(s) of said body of cylindrical geometry of said generator.

8. The device as claimed in claim 1, wherein said nozzles are arranged in families at the same height on the wall(s) of said body in such a way that the sum of the projections, onto a flat frame of reference perpendicular to the axis of symmetry of the generator, of the vectors leading from said axis of symmetry to the orifices of the nozzles is zero; the nozzles that make up one family having (almost) identical or substantially identical opening-pressure thresholds and diameters.

9. The device as claimed in claim 1, wherein said nozzles are arranged in pairs facing one another at the same height on the wall(s) of said body; the nozzles that make up one pair having identical or substantially identical opening-pressure thresholds and diameters.

10. The device as claimed in claim 1, wherein the internal volume of the body thereof is designed to accommodate and to hold, in a stable manner, at least one substantially cylindrical monolithic pyrotechnic block the thickness and equivalent diameter of which range between 10 and 75 mm.

* * * * *